US007612728B2

(12) United States Patent
Heinrich et al.

(10) Patent No.: US 7,612,728 B2
(45) Date of Patent: Nov. 3, 2009

(54) MICROWAVE ANTENNA FOR FLIP-CHIP SEMICONDUCTOR MODULES

(75) Inventors: Wolfgang Heinrich, Berlin (DE); Prodyut Talukder, Berlin (DE)

(73) Assignee: Forschungsverbund Berlin E.V., Berlin (DE)

( * ) Notice: Subject to any disclaimer, the term of this patent is extended or adjusted under 35 U.S.C. 154(b) by 619 days.

(21) Appl. No.: 10/593,337

(22) PCT Filed: Mar. 16, 2005

(86) PCT No.: PCT/EP2005/003303

§ 371 (c)(1),
(2), (4) Date: Sep. 19, 2006

(87) PCT Pub. No.: WO2005/091438

PCT Pub. Date: Sep. 29, 2005

(65) Prior Publication Data

US 2008/0238792 A1 Oct. 2, 2008

(30) Foreign Application Priority Data

Mar. 19, 2004 (DE) ..... 10 2004 014 018

(51) Int. Cl.
*H01Q 13/10* (2006.01)
*H01Q 1/42* (2006.01)

(52) U.S. Cl. ..... 343/767; 343/789

(58) Field of Classification Search ..... 343/700 MS, 343/767, 770, 771, 789

See application file for complete search history.

(56) References Cited

U.S. PATENT DOCUMENTS 5,903,239 A * 5/1999 Takahashi et al. ..... 343/700 MS
2002/0145566 A1 10/2002 Ballantine et al.

FOREIGN PATENT DOCUMENTS

DE 691 18 060 8/1996
EP 1 258 948 11/2002

(Continued)

OTHER PUBLICATIONS

Lubecke V.M. et al.:"Micromachining for Terahertz Applications", IEEE Transactions on Microwave Theory and Techniques, IEEE Inc., New York, US, vol. 46, No. 11, Part 2, Nov. 1998, pp. 1821-1831.

(Continued)

*Primary Examiner*—Shih-Chao Chen
(74) *Attorney, Agent, or Firm*—Pearl Cohen Zedek Latzer, LLP

(57) ABSTRACT

The invention relates to a microwave antenna for flip-chip semiconductor modules, comprising two semiconductor substrates which are metallized on the surface thereof. Patch antennas, i.e. metallized flat areas which are insulated from the rest of the circuit on an outer surface of a module with a supply line to the circuit, are already known per se. They result in vertical radiation at a relatively large angle. According to the invention, a closed group of bumps are arranged in such a way that the distance of the bumps (2) to each other is less than the half wavelength ($\lambda/2$) of the microsignal which is to be radiated or received and an open radiation slot arises in at least one pair of side walls (3,4) of the semiconductor substrates (a,b) and a bump, which is connected to the circuit of the semiconductor module, is arranged between the bumps (2) and the radiation slot, enabling the microwave antenna to be excited.

10 Claims, 2 Drawing Sheets

FOREIGN PATENT DOCUMENTS

JP 09252217 A * 9/1997

OTHER PUBLICATIONS

Munson, R.E.:"Conformed Microstrip Antennas and Microstrip Phase Arrays", IEEE Transactions on Antennas and Propagation, vol. 22, 1975, pp. 74-78.

Zurcher, J.F. and Gardiol, F.E.:"Broadband Patch Antennae", Boston, Artech House Inc., 1995.

International Search Report of Application No. PCT/EP2005/003303 dated Aug. 28, 2005.

* cited by examiner

MICROWAVE ANTENNA FOR FLIP-CHIP SEMICONDUCTOR MODULES

PRIOR APPLICATION DATA

The present application is a national phase application of International Application No. PCT/EP2005/003303, entitled "Microwave Antenna for Flip-Chip Semiconductor Modules", with international filing date, Mar. 16, 2005, which in turn claims priority from German application DE 10 2004 014018.9, filed on Mar. 19, 2004, all of which are incorporated by reference in their entirety.

FIELD OF THE INVENTION

The invention concerns a microwave antenna for semiconductor modules manufactured in flip-chip technology with two semiconductor substrates metallized on their surface.

BACKGROUND OF THE INVENTION

Circuits realized in flip-chip technology are widely known. In flip-chip technology, two semiconductor substrates lying in two planes, one above the other, are connected. For example, a semiconductor chip may be connected to a carrier medium or a base substrate. For connection of the two circuitry units, instead of wire bonds, so-called bumps (solder-coated or hard-cladded protuberances) are used. For example, in ball bumps, a wire is bonded to one of the substrates and subsequently melted off or pulled off. In this way, an electrically conductive raised point (protuberance) is created, which, when the two substrates are placed one above the other, may be brought into connection with a contact point of the opposite side—for example, through thermocompression.

On the substrates, monolithically integrated circuits are customarily constructed, whereby the bumps serve for electrical connection between the circuit elements. Individual bumps, however, may also be provided for the sole reason of maintaining a distance between the two substrates. The bumps are also commonly used for heat dissipation. A flip-chip module may be provided with its own transmission and/or reception antenna and, where appropriate, with its own power supply, so that autarchic transmission I reception modules come into existence. Patch antennas, which are metallized flat areas, isolated from the remaining circuitry on an outer surface of such a module with a supply line to the circuit, are known from prior art. The supply line, where appropriate, may be accomplished by means of a vertical through-connection ("via") through one of the substrates.

DE 691 18 060 T2, for example, discloses a microwave radar transmitter/receiver in flip-chip technology on the basis of a monolithically integrated microwave circuit (MMIC), which is equipped with such a patch antenna for transmission and reception of a close-range radar signal. More general explanations of patch antennas may be found in R. E. Munson, "Conformed Microstrip Antennas and Microstrip Phased Arrays", *IEEE Transactions on Antennas and Propagation,* Vol. 22, 1975, pp. 74-78, or in J. F. Zurcher, F. E. Gardiol, *Broadband Patch Antennas,* Boston, Artech House Inc., 1995.

The antennas known from prior art have the property of accomplishing a vertical radiation at a relatively large angle.

For certain applications, however, lateral radiation and/or reception by means of all-around radiation is desirable.

SUMMARY

The objective of the invention is to produce a microwave antenna of the type set forth above, which also enables lateral or all-around radiation and/or reception.

The task is solved according to the invention by the characteristics of Claim 1. Advantageous embodiments constitute the object of the dependent claims.

According to the invention, between the semiconductor substrates which are metallized on their surface a closed set of bumps is arranged in such a way that the distance between the bumps is less than half the wavelength of the microwave signal to be radiated or to be received, and, in at least one pair of side walls of the semiconductor substrates, an open radiation slot arises, and that, between the bumps and the radiation slot, a bump connected with the circuitry of the semiconductor module, is arranged, by means of which the excitation of the microwave antenna takes place.

The bumps give rise to a parallel plate-line structure with a lateral slot opening. This slot opening has a height which corresponds to the height of the bumps.

The radiation slot advantageously has a length approximately equal to half the wavelength of the microwave signal to be radiated or to be received. The height of the bumps should be significantly less than the wavelength of the microwave signal to be radiated or to be received.

The arrangement of the bumps together with the radiation slot is preferably one which results in an approximately triangular shape for the antenna area.

In order to increase the lateral directivity of the microwave antenna, the side walls of the semiconductor substrates in the area of the radiation slot are preferably at least partially metallized.

The microwave antenna enables the implementation of laterally directed radiating antennas with the help of well-established planar construction techniques. To date, the use of patch antennas constructed in the usual planar manner enabled this to be accomplished only in the vertical direction. The extension of the microwave antenna, in this context, amounts to only half the wavelength. It is therefore especially suitable for the frequency range between 10 and 150 GHz and enables the construction of miniaturized integrated beam transmitters.

A further advantage of the microwave antenna of according to the invention is that only a small amount of space on the outer surface of the module must be set aside for an antenna.

By means of an arrangement of a plurality of microwave antennas on the semiconductor substrates, a radiation angle of up to 360° can be obtained. In addition, the microwave antenna, relative to be patch antennas known from prior art, has the particular advantage that it can simultaneously be used as a filter, because the bump by means of which the excitation of the microwave antenna takes place can be positioned in such a way that the microwave antenna exhibits an impedance adjustment only for the resonance frequency.

In combination with one or more patch antennas, the microwave antenna according to the invention advantageously enables all-around radiation to be achieved in all spatial directions.

The construction of a module with a microwave antenna according to the invention is achieved by means of the flip-chip technology known from prior art. The substrates are manufactured by means of a coplanar MMIC process (MMIC=Microwave Monolithic Integrated Circuits), either only as metallizations or, where appropriate, as circuits. As part of the processing of the back, the side walls are advantageously metallized as via fences on the edges, and the required electrical connections between the front and the back are realized as vias. Subsequently, the bumps are introduced onto one of the substrates and the wafers are separated into chips, followed by the flip-chip bonding of the two chips (substrates).

The construction according to the invention enables the manufacture of semiconductor modules, for example, for close-range radar systems and other sensors, micro-module labels and all kinds of chip cards and similar systems, including disposable articles, which communicate over small distances in the GHz range. A combination with the patch antennas known from prior art is also possible, so as to achieve spherical radiation.

BRIEF DESCRIPTION OF THE DRAWINGS

The invention is explained in greater detail below, by means of examples of embodiments. The relevant drawings show the following.

DETAILED DESCRIPTION OF THE INVENTION

Figure 1:
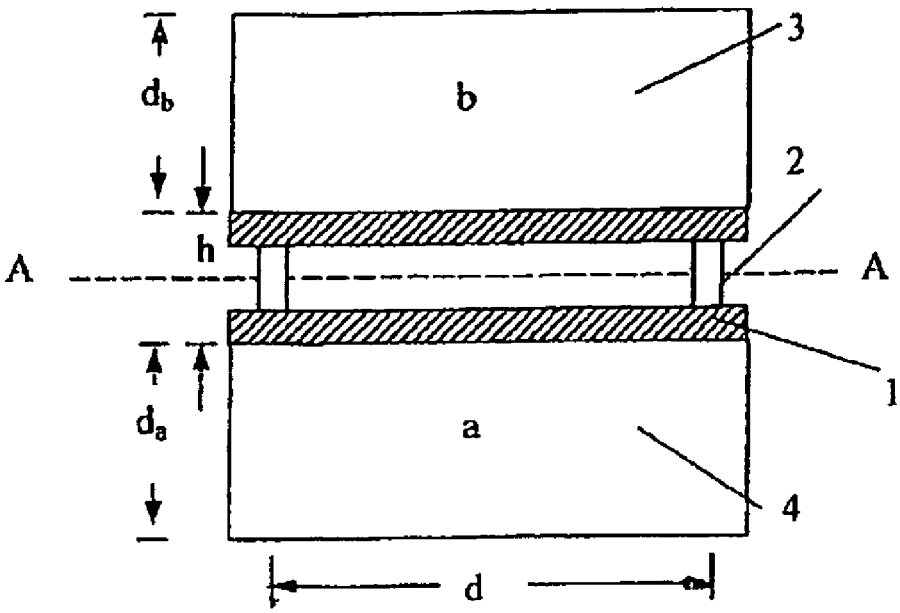
FIG. 1: a side view of a flip-chip module with a microwave antenna according to the invention.

FIG. 1 shows a side view of a flip-chip module with a microwave antenna according to the invention. The antenna is illuminated by flip-chip assembly of two substrates a and b, metallized on their surface (the metallization is designated by 1). These may also be semiconductor substrates with integrated circuits. As is customary in flip-chip technology, the surfaces of both substrates a and b are connected to each other by means of bumps 2. This gives rise to a parallel plate-line structure with a lateral slot opening, with a slot length d, between substrates a and b. This slot opening has a height h which corresponds to the height h of the bumps 2. Typically, the height h is between 50 and 100 μm and is accordingly significantly smaller than the free space wavelength $\lambda_0$ for a frequency range between 10 and 150 GHz. The side walls 3 and 4 of substrates a and b should be good conductors in order to achieve lateral directivity. Accordingly, they are provided with a metallization 5, which is indicated as continuous in this figure, but can also be advantageously implemented by means of via fences on the edges of substrates a and b. The total height of the layer stack $d_a+d_b+h$ (where $d_a$, $d_b$=thickness of substrates a and b) should not be less than one-tenth of the free space wavelength $\lambda_0$.

Figure 2:
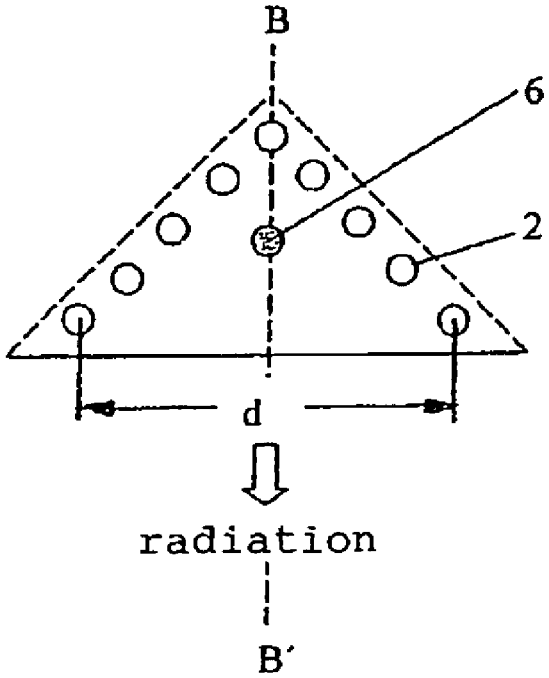
FIG. 2: a cutaway view of plane A-A' in FIG. 1 with the series of bumps according to the invention and a typical excitation location I/O.
Figure 3:
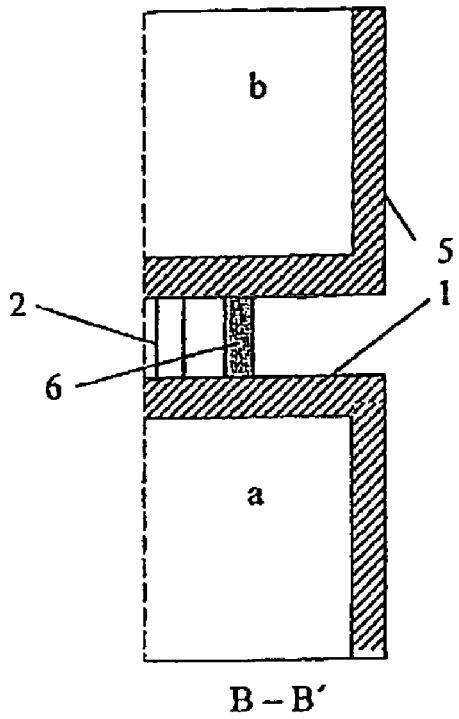
FIG. 3: a cutaway view of plane B-B' in FIG. 2.

FIG. 2 shows a cross-section in the plane A-A' in FIG. 1—that is, in the antenna plane; FIG. 3 shows a cross-section through the plane of symmetry B-B' in FIG. 2. The microwave antenna consists of the triangular cavity, formed by the correspondingly arranged bumps 2 between the two substrates a and b. On the long, front side, the cavity is open for radiation (slot length d); on each of the other two sides, it is screened by a series of bumps 2. The distance between the bumps 2 is less than half the free space wavelength $\lambda_0/2$. The slot length d must be approximately equal to half the free space wavelength $\lambda_0/2$. The antenna arrangement is similar to a horn antenna; however, due to the small height h and the conducting side walls 3 and 4, its operation is closer to that of a slot antenna.

The excitation of the antenna—that is, the signal input in the case of transmission, or the output gate in the case of reception—takes place locally between the two substrates a and b by means of an I/O bump 6. When appropriate, this I/O bump 6 can be directly connected with a coplanar front end circuit integrated onto substrate a and/or b, in order to minimize input losses. Because a coplanar circuit has mass services connected to each other and generally takes up only a small part of the triangular antenna area, this leads to only small changes in the antenna behavior.

The microwave antenna shown in this embodiment operates as a cavity resonator which is energized by the radiation. This property can be used for narrow-band transformation, while the position of the I/O bump 6 is optimized. In so doing, a filter effect is simultaneously achieved: all frequencies except for the resonance frequency are poorly aligned and are therefore damped. The resonance frequency is basically dictated by the dimensions of the triangle formed by the bumps 2.

Figure 4:
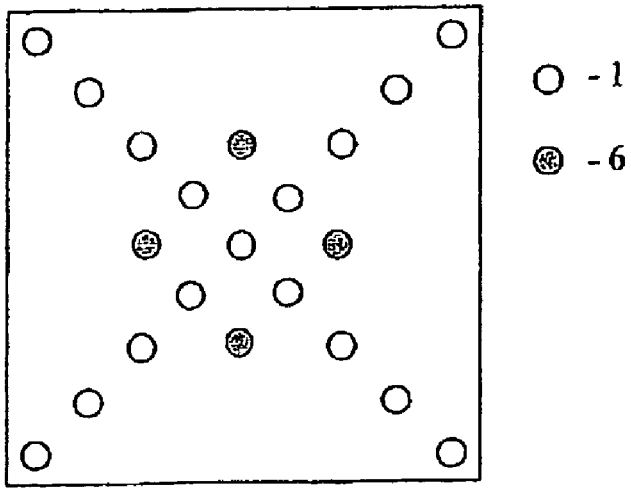
FIG. 4: a representation according to FIG. 2 where the antenna is a four-sector antenna.

The structure according to FIGS. 1 to 3 may be completed to a four-sector antenna, which, as shown in FIG. 4, then covers a 360° range.

In a concrete embodiment for a 24 GHz antenna, the substrates a and b were implemented as gallium arsenide (GaAs) substrates (each of substrates a and b was 625 μm thick) with gold metallization). The slot length d was 12.5 mm. The conducting side walls 3 and 4 were implemented by means of via chains (diameter 400 μm, pitch (distance between mid points) 1 mm). The bumps 2 were constructed as gold-tin (AuSn) bumps with a diameter of about 80 μm; the chips were flip-chip soldered with a resulting height h of approximately 80 μm. The front end circuits were arranged in a coplanar manner within a triangular antenna area (for example, on substrate a). The excitation of the antenna took place by means of an I/O bump 6, which connects the front end to the metallization 1 on substrate b. The intermediate frequency or base band output of the front end circuits was conducted by means of vias to the back of substrate a.

REFERENCE LIST

1 Metallization
2 Bump
3 Side wall
4 Side wall
5 Metallization
6 I/O bump
a,b Substrates
d Slot length
h Height
$d_a$ Thickness (of substrate a)
$d_b$ Thickness (of substrate b)
$\lambda_0$ Free space wavelength

The invention claimed is:

1. A microwave antenna for flip-chip semiconductor modules, comprising:

two semiconductor substrates, which are metallized on a surface thereof, wherein a closed group of bumps are arranged between the semiconductor substrates in such a way that the distance between the bumps in the closed group of bumps is less than half of the wavelength of a microwave signal which is to be radiated or received;

an open radiation slot in at least one pair of side walls of the semiconductor substrates; and a bump, connected to a circuit of a semiconductor module, arranged between the closed group of bumps and the radiation slot, enabling the microwave antenna to be excited.

2. The microwave antenna of claim 1, wherein the closed group of bumps and the radiation slot are positioned in a triangular shape.

3. The microwave antenna of claim 1, wherein the length of the radiation slot is approximately half of the wavelength of the microwave signal.

4. The microwave antenna of claim 1, wherein the height of the closed group of bumps is considerably less than half of the wavelength of the microwave signal.

5. The microwave antenna of claim 1, wherein the height of the semiconductor module is higher by one tenth of the of the microwave signal.

6. The microwave antenna of claim 1, wherein the side walls of the semiconductor substrates in the area of the radiation slot are at least in part provided with metallization.

7. The microwave antenna of claim 6, wherein the metallization of the side walls of the semiconductor substrates is implemented by means of via chains.

8. The microwave antenna of claim 1, wherein the bump, which is connected to the circuit of the semiconductor module, is positioned in such a manner that the microwave antenna will have impedance matched to the resonance frequency of the microwave antenna.

9. The microwave antenna of claim 1, wherein at least on one of the semiconductor substrates a monolithically integrated circuit is arranged in the area of the antenna range opened up by the bumps and the radiation slot.

10. The microwave antenna of claim 1, wherein bumps in the closed group of bumps set between the semiconductor substrates are arranged in the shape of a cross, so that a four-sector antenna is created.

* * * * *